US010471733B2

(12) United States Patent
Uematsu

(10) Patent No.: US 10,471,733 B2
(45) Date of Patent: Nov. 12, 2019

(54) PRINTING DEVICE, PRINTING METHOD, AND NONVOLATILE COMPUTER-READABLE RECORDING MEDIUM

(71) Applicant: CASIO COMPUTER CO., LTD., Shibuya-ku, Tokyo (JP)

(72) Inventor: Kenji Uematsu, Hanno (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 9 days.

(21) Appl. No.: 15/673,379

(22) Filed: Aug. 9, 2017

(65) Prior Publication Data

US 2018/0086100 A1 Mar. 29, 2018

(30) Foreign Application Priority Data

Sep. 26, 2016 (JP) ..... 2016-186751
Jul. 5, 2017 (JP) ..... 2017-131649

(51) Int. Cl.

| | |
|---|---|
| ***B41J 2/35*** | (2006.01) |
| ***B41J 2/355*** | (2006.01) |
| ***B41J 3/407*** | (2006.01) |
| ***B41J 29/387*** | (2006.01) |
| ***B41J 2/325*** | (2006.01) |
| ***B41J 29/38*** | (2006.01) |

(52) U.S. Cl.

CPC ..... *B41J 2/355* (2013.01); *B41J 2/325* (2013.01); *B41J 3/4075* (2013.01); *B41J 29/38* (2013.01); *B41J 29/387* (2013.01)

(58) Field of Classification Search

None

See application file for complete search history.

(56) References Cited

U.S. PATENT DOCUMENTS 9,031,468 B2 * 5/2015 Itagaki ..... G03G 15/2039 399/195
2011/0157266 A1 * 6/2011 Yamada ..... B41J 2/30 347/9
2013/0136479 A1 * 5/2013 Yuasa ..... G03G 15/2046 399/69

FOREIGN PATENT DOCUMENTS

| | | | |
|---|---|---|---|
| JP | 05238045 | A | 9/1993 |
| JP | 2000295447 | A | 10/2000 |
| JP | 2004338094 | A | 12/2004 |
| JP | 2006088406 | A | 4/2006 |

(Continued)

OTHER PUBLICATIONS

Japanese Office Action (and English language translation thereof) dated Jun. 12, 2018 issued in counterpart Japanese Application No. 2017-131649.

*Primary Examiner* — Matthew Luu
*Assistant Examiner* — Tracey M McMillion
(74) *Attorney, Agent, or Firm* — Holtz, Holtz & Volek PC

(57) ABSTRACT

A printing device, includes a printer that prints onto a printing medium that is conveyed along a reference direction by a conveyer; and a controller that controls the printer to print a print pattern onto the printing medium along the reference direction. The controller controls to forbid the printer to execute printing when a temperature of the printer is projected to become equal to or higher than a set temperature if the printer prints onto the printing medium using a printing length of the print pattern along the reference direction, the printing length being a length of at least a portion of the print pattern along the reference direction.

5 Claims, 9 Drawing Sheets

(56) References Cited

FOREIGN PATENT DOCUMENTS

| | | | |
|---|---|---|---|
| JP | 2006212826 | A | 8/2006 |
| JP | 2011062896 | A | 3/2011 |
| JP | 2012148526 | A | 8/2012 |
| JP | 2014010506 | A | 1/2014 |
| JP | 2016155318 | A | 9/2016 |

* cited by examiner

PRINTING DEVICE, PRINTING METHOD, AND NONVOLATILE COMPUTER-READABLE RECORDING MEDIUM

CROSS-REFERENCE TO RELATED APPLICATION

This application claims the benefit of Japanese Patent Application No. 2016-186751, filed on Sep. 26, 2016 and Japanese Patent Application No. 2017-131649, filed on Jul. 5, 2017, of which the entirety of the disclosures is incorporated by reference herein.

FIELD

This application relates generally to a printing device printing onto a printing medium, a printing method executed by a controller provided to the printing device, and a nonvolatile computer-readable recording medium on which a program used by a computer of a printing device is recorded.

BACKGROUND

Conventionally, printing devices are known in which ink applied on an ink ribbon is transferred to a printing medium by controlling energization of heater elements provided to a thermal head based on a desired print pattern. Such a printing device is described in, for example, Unexamined Japanese Patent Application Kokai Publication No. 2011-062896.

The temperature of the thermal head rises along with printing and in some cases, rises above the upper limit of the operation-guaranteed temperature. In order to prevent damage and/or defective operation due to heat to the thermal head in such a case, it is conceivable to lower the temperature of the thermal head by suspending the printing in the middle of printing.

However, printing is performed with the thermal head and the printing medium being in contact. Therefore, suspension of printing in the middle of printing may lead to resultant print blurred or collapsed, thereby deteriorating the print quality. Moreover, suspension of printing in the middle of printing may cause unevenness such as slight difference in density between when printing is suspended and when printing is resumed, thereby deteriorating the print quality from this viewpoint.

A conceivable countermeasure is to separate the thermal head and the printing medium while printing is suspended in the middle of printing. However, separating the thermal head and the printing medium may cause a gap and/or a shift in the resultant print when printing is resumed, eventually deteriorating the print quality. Moreover, it is also conceivable to change the configuration of the printing device so that the thermal head and the printing medium are separated and no gap or shift occurs in the print. However, such a change in the configuration complicates the configuration of a printing device.

SUMMARY

The printing device according to the present disclosure is a printing device, comprising:

a printer that prints onto the printing medium that is conveyed along a reference direction by a conveyer; and a controller that controls the printer to print a print pattern onto the printing medium along the reference direction, wherein the controller controls to forbid the printer to execute printing when a temperature of the printer is projected to become equal to or higher than a set temperature if the printer prints onto the printing medium using a printing length of the print pattern along the reference direction, the printing length being a length of at least a portion of the print pattern along the reference direction.

The printing method according to the present disclosure is a printing method comprising:

printing a print pattern onto the printing medium that is conveyed along a reference direction, by a printer, along the reference direction wherein the printing method further includes controlling to forbid the printer to execute printing when a temperature of the printer is projected to become equal to or higher than a set temperature if the printer prints onto the printing medium using a printing length of the print pattern along the reference direction, the printing length being a length of at least a portion of the print pattern along the reference direction.

The printing method according to the present disclosure is a printing method comprising:

printing a print pattern onto a printing medium, that is conveyed along a reference direction, by a printer, along the reference direction;

wherein the printing method includes:

controlling to forbid the printer to execute printing when a length of the print pattern along the reference direction is equal to or greater than a reference length and an amount of temperature change of the printer is projected to become equal to or higher than a reference value, and controlling to allow the printer to execute printing when the length of the print pattern along the reference direction is less than the reference length and an amount of temperature change of the printer is projected to become less than the reference value.

The printing method according to the present disclosure is a printing method comprising:

printing a print pattern onto a printing medium, that is conveyed along a reference direction, by a printer, along the reference direction;

wherein the printing method includes:

controlling to forbid the printer to execute printing if a projected amount of temperature change of the printer when the controller controls the printer to print all dots for a full length of the print pattern is equal to or higher than a reference value, and controlling to allow the printer to execute printing if the projected amount of temperature change of the printer is lower than the reference value.

The nonvolatile computer-readable recording medium according to the present disclosure is a nonvolatile computer-readable recording medium on which a program is stored, the program causing a controller of a printing device to execute the following procedure:

printing a print pattern onto a printing medium that is conveyed along a reference direction, by a printer, along the reference direction, wherein the printer are controlled so as to forbid the printer to execute printing when a temperature of the printer is projected to become equal to or higher than a set temperature if the printer prints onto the printing medium using a printing length of the print pattern along the reference direction, the printing length being a length of at least a portion of the print pattern along the reference direction.

BRIEF DESCRIPTION OF THE DRAWINGS

A more complete understanding of this application can be obtained when the following detailed description is considered in conjunction with the following drawings, in which.

DETAILED DESCRIPTION

The printing device, the printing method of the printing device, and the program according to embodiments of the present disclosure will be described below with reference to the drawings.

Embodiment 1

Figure 1:
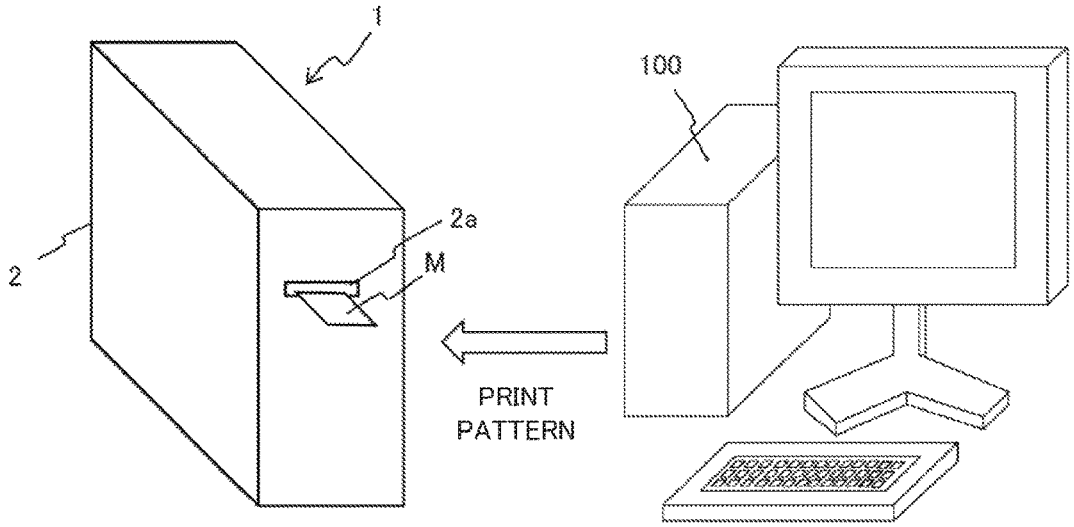
FIG. 1 is a perspective view of the printing device according to Embodiment 1.

FIG. 1 is a perspective view of a printing device 1 according to Embodiment 1.

The printing device 1 shown in FIG. 1 is, for example, a label printer printing on an elongated printing medium M in the single path system. The following explanation will be made in regard to a thermal-transfer label printer using an ink ribbon by way of example. However, the printing method is not particularly restricted. For example, a heat sensitive method using thermal paper may be used. The printing device 1 acquires printing information such as a print pattern from a computer 100. The computer 100 creates a print pattern to print onto the printing medium M based on user operations. The printing medium M is, for example, a tape member having a base having an adhesive layer and a releasable paper attached to the base in a releasable manner to cover the adhesive layer. However, the printing medium M may be a tape member with no releasable paper.

A device enclosure 2 of the printing device 1 has a discharge slot 2*a* formed to discharge the printing medium M outside the device enclosure 2. The device enclosure 2 is provided with a power supply cord connection terminal, an external device connection terminal functioning as an interface 8 described later, and a storage medium insertion opening, as well as with an open/close cover for mounting/demounting a tape cassette 30 described later.

Figure 2:
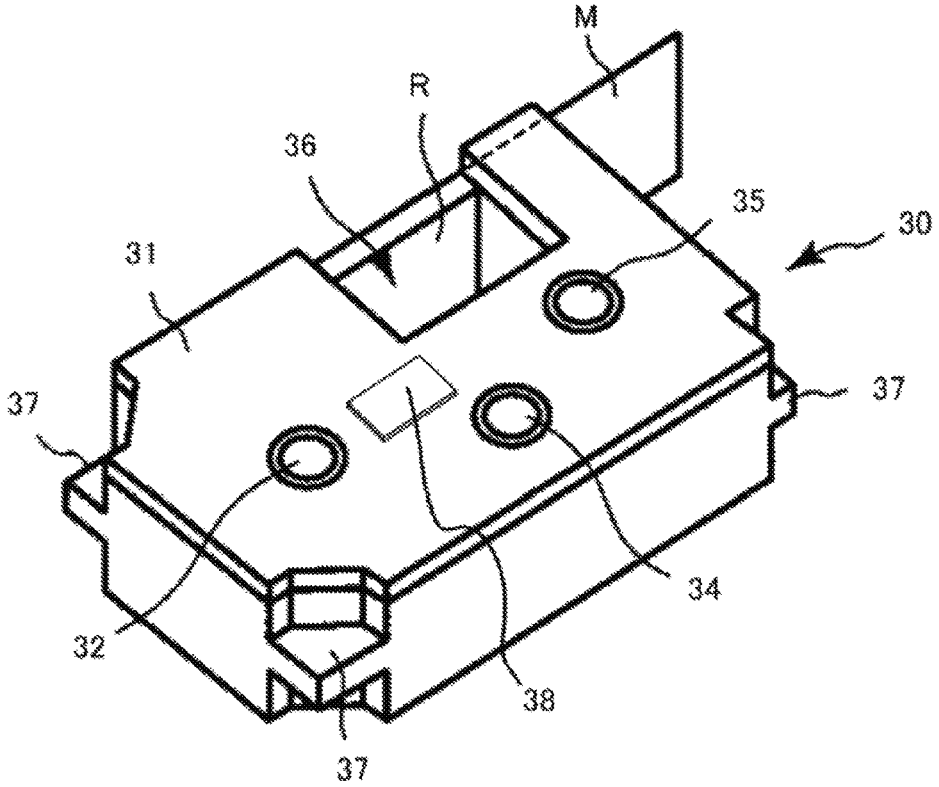
FIG. 2 is a perspective view of a tape cassette to be housed in the printing device according to Embodiment 1.

FIG. 2 is a perspective view of the tape cassette 30 to be housed in the printing device 1.

Figure 3:
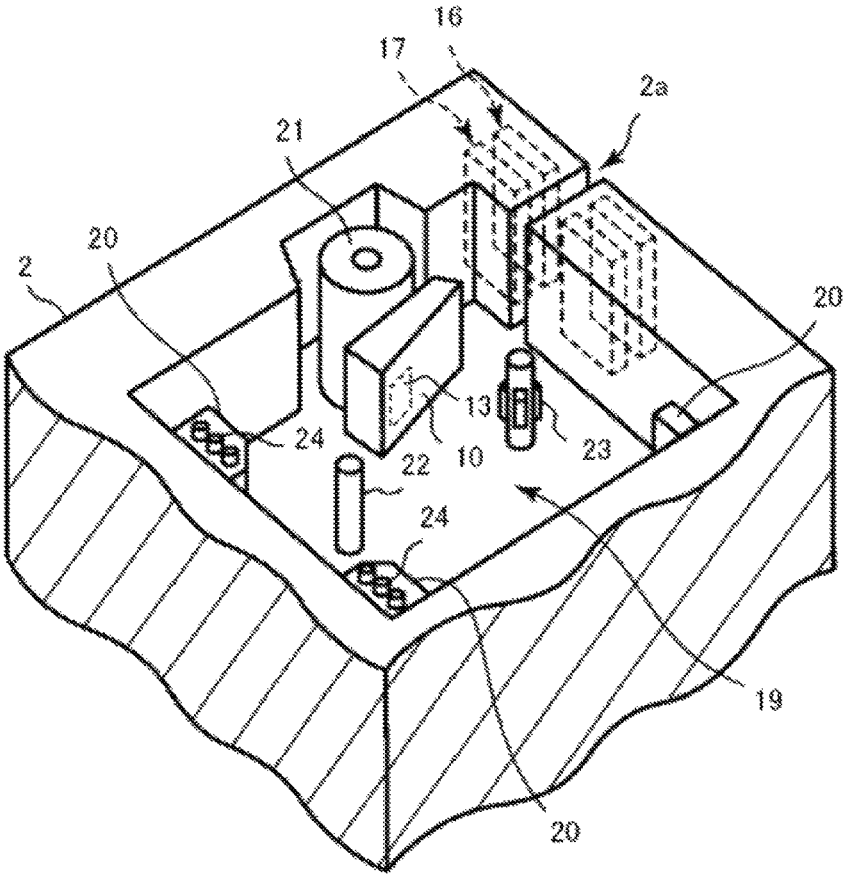
FIG. 3 is a perspective view of the cassette housing of the printing device according to Embodiment 1.

FIG. 3 is a perspective view of a cassette housing 19 of the printing device 1.

Figure 4:
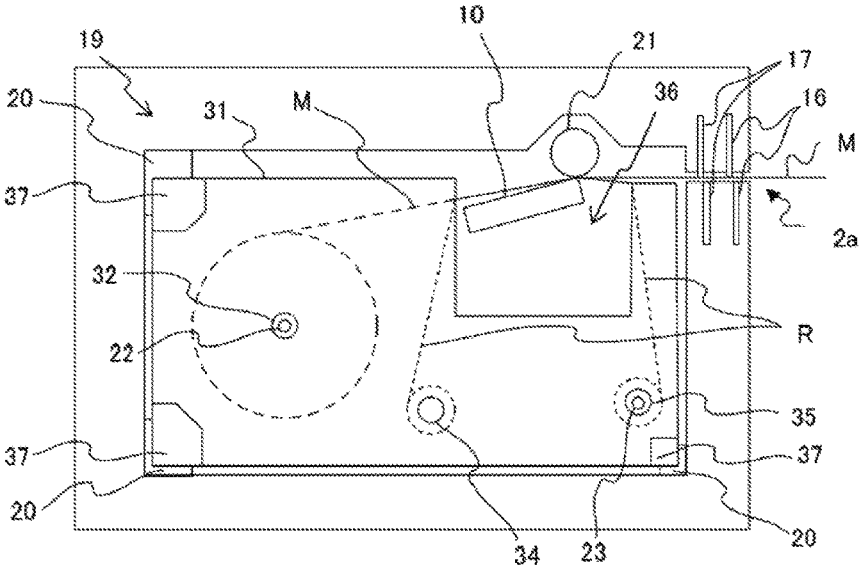
FIG. 4 is a cross-sectional view of the printing device according to Embodiment 1.

FIG. 4 is a cross-sectional view of the printing device 1.

The tape cassette 30 shown in FIG. 2 is detachably housed in the cassette housing 19 shown in FIG. 3. FIG. 4 shows the state in which the tape cassette 30 is housed in the cassette housing 19.

Figure 5:
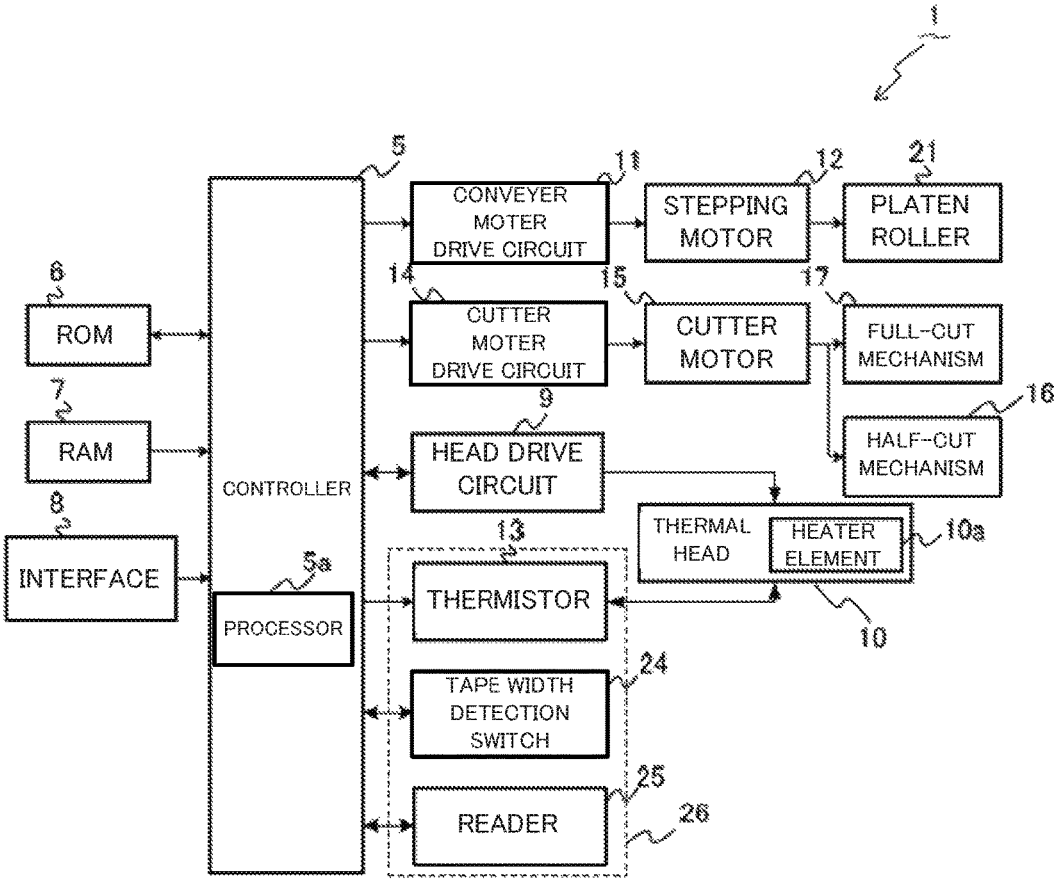
FIG. 5 is a control block diagram of the printing device according to Embodiment 1.

The tape cassette 30 has, as shown in FIG. 2, a cassette case 31 having a thermal head inserter 36 and engagers 37 formed and housing the printing medium M and an ink ribbon R. An identification tag 38 is attached to a surface of the cassette case 31. The identification tag 38 is, for example, a radio frequency identifier (RFID) tag and has an identifier recorded for identifying the tape cassette 30 (then, the printing medium M and/or the ink ribbon R housed in the tape cassette 30). A reader 25 shown in FIG. 5 is, for example, an RFID reader and reads an identifier (identification information) from the identification tag 38 to identify the tape cassette 30 and then the printing medium M and/or the ink ribbon R housed in the tape cassette 30, and outputs a sensor signal presenting the identifier. A controller 5 described later can acquire information of the material of the printing medium M and/or the material of the ink ribbon R (in other words, the material of ink printed onto the printing medium M) from the sensor signal output as just described. Here, it is also possible to acquire information of the materials of the printing medium M and/or the ink by receiving user input with the printing device 1 or the computer 100 shown in FIG. 1.

The cassette case 31 is provided with a tape core 32, an ink ribbon feed core 34, and an ink ribbon roll-up core 35. The printing medium M is wound around the tape core 32 into a roll within the cassette case 31. Moreover, the thermal-transfer ink ribbon R is wound around the ink ribbon feed core 34 into a roll within the cassette case 31 with the leading end wound around the ink ribbon roll-up core 35.

The cassette housing 19 of the device enclosure 2 is provided with multiple cassette receivers 20 for supporting the tape cassette 30 at a given position as shown in FIG. 3. Moreover, the cassette receivers 20 are provided with tape width detection switches 24 for detecting the width of a tape (the printing medium M) housed in the tape cassette 30. The tape width detection switches 24 are an example of the width detector detecting the width of the printing medium M housed in the tape cassette 30 based on the shape of the tape cassette 30 (an irregular shape provided to the tape cassette 30), and output a sensor signal presenting the detected width of the printing medium M and the ink ribbon R. Here, the width of the printing medium M and/or the ink ribbon R can be acquired by the reader 25 reading the above-described identifier of the identification tag 38 or by receiving user input with the printing device 1 or the computer 100 shown in FIG. 1. Moreover, the tape width detection switches 24 may acquire the material of the printing medium M and/or the material of the ink ribbon R.

The cassette housing 19 is further provided with a thermal head 10 having multiple heater elements 10*a* printing onto the printing medium M, a platen roller 21 conveying the printing medium M, a tape core engaging shaft 22, and an ink ribbon roll-up drive shaft 23. Furthermore, a thermistor 13 is embedded in the thermal head 10. Here, the thermistor 13 is an example of the temperature sensor measuring the temperature of the thermal head 10 and outputs a sensor signal presenting the measured temperature. Moreover, the thermal head 10 is an example of the printer printing onto the printing medium M based on an entered print pattern. Moreover, the platen roller 21 functions as the conveyer conveying the printing medium M together with a stepping motor 12 described later.

With the tape cassette 30 being housed in the cassette housing 19, as shown in FIG. 4, the engagers 37 provided to the cassette case 31 are supported by the cassette receivers 20 provided to the cassette housing 19. The thermal head 10 is inserted into the thermal head inserter 36 formed in the cassette case 31. Moreover, the tape core 32 of the tape cassette 30 engages with the tape core engaging shaft 22. Furthermore, the ink ribbon roll-up core 35 engages with the ink ribbon roll-up drive shaft 23.

As a print order is entered into the printing device 1 from the computer 100 shown in FIG. 1, the printing medium M is dispensed from the tape core 32 by rotation of the platen roller 21. At this point, the ink ribbon roll-up drive shaft 23 rotates in sync with the platen roller 21, whereby the ink ribbon R is dispensed from the ink ribbon feed core 34 along with the printing medium M. As a result, the printing medium M and the ink ribbon R are conveyed in an overlapped state. Then, while passing between the thermal head 10 and the platen roller 21, the ink ribbon R is heated by the thermal head 10, whereby ink is transferred to the printing medium M for printing.

The used ink ribbon R after passing between the thermal head 10 and the platen roller 21 is rolled up by the ink ribbon roll-up core 35. On the other hand, the printed printing medium M after passing between the thermal head 10 and the platen roller 21 is cut by a half-cut mechanism 16 and a full-cut mechanism 17 and discharged from the discharge slot 2*a* as a print.

FIG. 5 is a control block diagram of the printing device 1.

The printing device 1 shown in FIG. 5 comprises, in addition to the thermal head 10, the thermistor 13, the half-cut mechanism 16, the full-cut mechanism 17, the platen roller 21, the tape width detection switches 24, and the reader 25, a controller 5, a read only memory (ROM) 6, a random access memory (RAM) 7, an interface 8, a head drive circuit 9, a conveyer motor drive circuit 11, a stepping motor 12, a cutter motor drive circuit 14, and a cutter motor 15. Here, the controller 5, the ROM 6, and the RAM 7 cooperate to function as the computer of the printing device 1.

The controller 5 includes a processor 5*a* such as a central processing unit (CPU). The controller 5 loads on the RAM 7 and executes programs stored in the ROM 6 to control the operations of the parts of the printing device 1. Therefore, it can be said that the controller 5 is a head controller controlling energization of the heater elements 10*a* of the thermal head 10 via the head drive circuit 9. Moreover, it can also be said that the controller 5 is a conveyance controller controlling the stepping motor 12 and the platen roller 21 functioning as the conveyer via the conveyer motor drive circuit 11.

The ROM 6 stores a print program for printing onto the printing medium M and various data necessary for executing the print program (for example, fonts and the like). The ROM 6 also functions as a storage medium storing programs readable by the controller 5.

The RAM 7 functions an input data memory storing printing information such as a print pattern P10 shown in FIG. 8 described later and the width of the printing medium M. The interface 8 is wired- or wireless-connected to the computer 100 shown in FIG. 1 and receives printing information such as the print pattern P10 from the computer 100.

The head drive circuit 9 energizes multiple heater elements 10*a* based on the print pattern while a strobe signal is ON. The thermal head 10 is a print head having multiple heater elements 10*a* arrayed in the main scanning direction. As the head drive circuit 9 selectively energizes the heater elements 10*a* according to a print pattern during the energization period of a strobe signal transmitted by the controller 5, the thermal head 10 heats the ink ribbon R with the heater elements 10*a* to print onto the printing medium M by thermal transfer line by line.

The conveyer motor drive circuit 11 drives the stepping motor 12. The stepping motor 12 drives the platen roller 21. Rotating by the motive power of the stepping motor 12, the platen roller 21 conveys the printing medium M in the longitudinal direction of the printing medium M (the sub-scanning direction).

The cutter motor drive circuit 14 drives the cutter motor 15. The half-cut mechanism 16 and the full-cut mechanism 17 operate by the motive force of the cutter motor 15 and half-cut or full-cut the printing medium M. The full cut is an operation to cut the base of the printing medium M together with the releasable paper along the width direction. The half-cut is an operation to cut only the base along the width direction. Here, in the case of adopting a printing device that does not cut the printing medium M, the cutter motor drive circuit 14, the cutter motor 15, the half-cut mechanism 16, and the full-cut mechanism 17 may be omitted.

The thermistor 13 measuring the temperature of the thermal head 10, the tape width detection switches 24 detecting the width of the printing medium M, and the reader 25 identifying the tape cassette 30 constitute a sensor 26 of the printing device 1. Here, the sensor 26 can include any configuration acquiring information with which the printing environment of the printing device 1 is identified. Therefore, the sensor 26 may include other configurations in addition to the above-described configuration.

The printing device 1 acquires printing information such as a print pattern from the computer 100 that is different from the printing device 1 as shown in FIG. 1. Therefore, it can be said that compared with a printing device comprising an input device and a display and generating a print pattern as well, successive printing is more likely to be performed and cause the temperature rise of the thermal head 10 described later. However, the printing device 1 may comprise an input device and a display. This input device includes, for example, an input device having any or all of input keys for entering characters, icons, graphics, and the like, a print key for giving a print start order, a cursor key for moving a cursor on the display screen of the display, various control keys for setting print modes and/or performing various setting procedures, and the like. Moreover, the display includes, for example, a display that is a liquid crystal display panel and displays a selection menu for characters, icons, graphics, and the like corresponding to input from the input device and/or various settings, a screen for giving notice to the user upon errors, messages regarding various procedures, and the like. Here, the display may be provided with a touch panel unit and in such a case, the display functions as a part of the input device.

Figure 6:
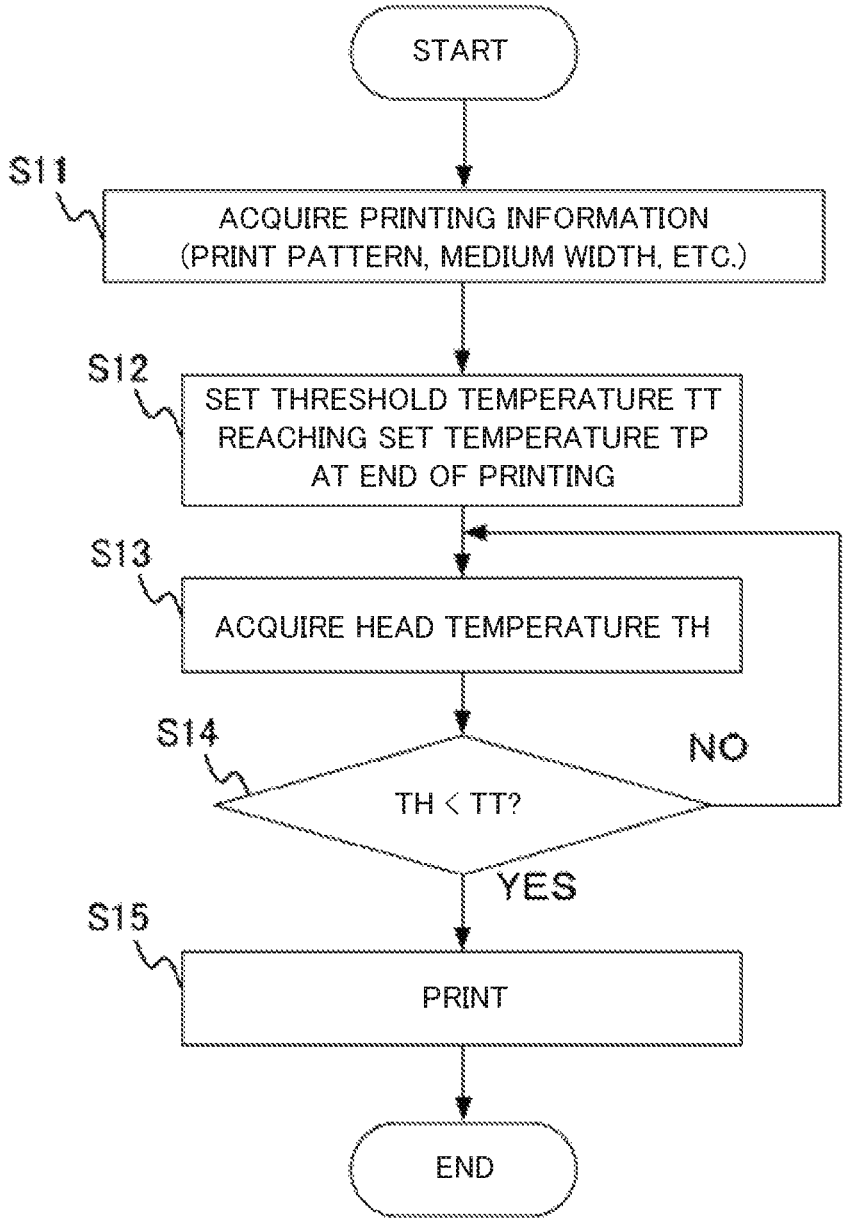
FIG. 6 is a flowchart for explaining the control method of the printing device according to Embodiment 1.

FIG. 6 is a flowchart for explaining the control method of the printing device 1.

The procedure shown in FIG. 6 is executed by the controller 5 given a print start order from the user via the computer 100 shown in FIG. 1 reading a given program recorded on the ROM 6.

Figure 8:
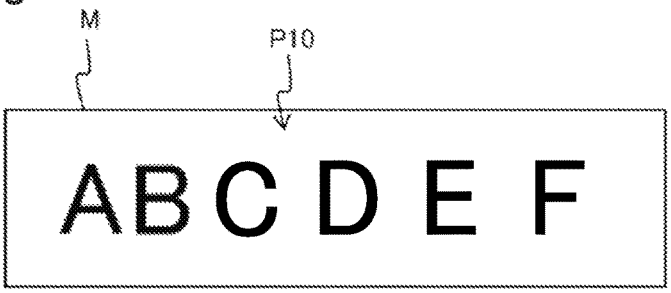
FIG. 8 is an illustration for explaining a print pattern in Embodiment 1.

First, the controller 5 acquires printing information such as the print pattern P10 comprising characters "ABCDEF" shown in FIG. 8, the width and/or material of the printing medium M, and the material of the ink (Step S11). As described above, the print pattern P10 is acquired from, for example, the computer 100 shown in FIG. 1. Moreover, the width of the printing medium M is acquired from, for example, the tape width detection switches 24. Furthermore, the materials of the printing medium M and the ink are acquired from, for example, the reader 25. Here, the printing information may include other information such as the length in the conveying direction of a print created from the printing medium M.

Then, the controller 5 sets a threshold temperature TT for projecting and determining whether the temperature of the thermal head 10 (hereafter, the head temperature) TH rises along with printing and reaches a preset upper limit temperature TP by the end of printing of the print pattern P10 shown in FIG. 8 (Step S12).

Figure 7:
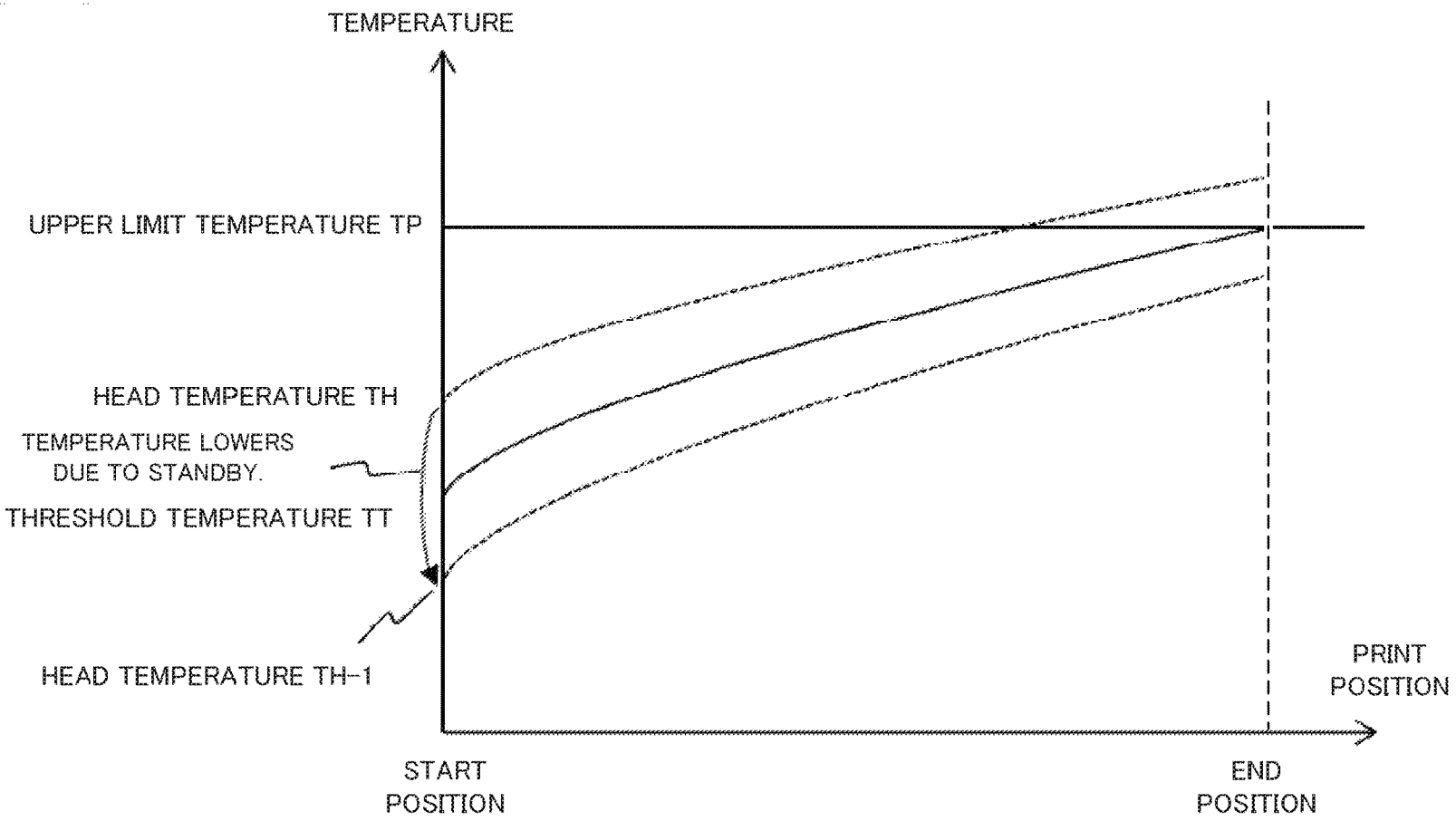
FIG. 7 is a graph for explaining the projected temperature rise in Embodiment 1.

FIG. 7 is a graph showing an exemplary temperature change of the thermal head 10 corresponding to the print position. The ordinate (the origin) position of the graph corresponds to the print start position (the rear end (the right side) of a leading marginal region A18 in FIG. 11 described later), and the dotted line position corresponds to the print end position (the front end (the left side) of a trailing marginal region A19 in FIG. 11). The threshold temperature TT in FIG. 7 is a temperature at the start of printing (or at the resumption of printing) from which the temperature of the thermal head 10 is projected to reach the upper limit temperature TP at the end of printing in prospect of the temperature rising along with printing. As shown in FIG. 7, the temperature of the thermal head 10 rises as printing progresses and the magnitude of temperature rise (the temperature change rate) from the start of printing corresponding to the print position varies depending on the print pattern P10. Therefore, the actual threshold temperature TT varies depending on the print pattern P10. However, as described next, the controller 5 may set a threshold temperature TT in consideration of the maximum magnitude of temperature rise. Specifically, the controller 5 may set a threshold temperature TT in consideration of the temperature rise of the thermal head 10 when the heater elements 10*a* are energized for printing all dots in every line for the entire length of the print pattern P10 to print, in other words for the entire length in the longitudinal direction of the printing medium M excluding the leading margin and/or the trailing margin of a label to create. This print pattern (all dots-print pattern) P10 corresponds to printing all dots in the entire printable region within the entire length of a label to create and in such a case, the magnitude of temperature rise is the largest among all print patterns P10.

On the other hand, a general print pattern P10 includes characters and graphics and its magnitude of temperature rise is smaller than the above all dots-print pattern P10. Thus, the controller 5 can set the threshold temperature TT higher than for the all dots-print pattern P10. Therefore, the controller 5 may project the head temperature TH that is the temperature of the thermal head 10 corresponding to the print position based on the print pattern P10. For example, the controller 5 may project the magnitude of temperature rise corresponding to the print position based on the total number of print dots in the print pattern P10 corresponding to making the heater elements 10*a* generate heat and/or the ratio of the total number of print dots to the total number of print dots and non-print dots included in the entire length of the print pattern P10 wherein the non-print dots correspond to not making the heater elements 10*a* generate heat, or the total number of lines of the print pattern P10 in each of which the number of print dots exceeds a separately set threshold (exceeding lines) and/or the ratio of the total number of exceeding lines to all lines included in the entire length of the print pattern P10, and set a threshold temperature TT according to the projected magnitude of temperature rise. Here, the head temperature TH is closer to the environment temperature at the start of printing or at the resumption of printing as the suspension time is longer. Therefore, the head temperature TH tends to rise immediately after the start of printing or the resumption of printing. The controller 5 may reflect this phenomenon in the projected raised temperature.

For example, the controller 5 can project the raised temperature based on the print pattern P10 by acquiring corresponding calculation conditions from a given table based on at least one of the above-described total number and ratio of the number of heater elements 10*a* made to generate heat for printing the print pattern P10 and calculating. Moreover, the controller 5 may project the raised temperature based on at least one of the width of the printing medium M, the material of the printing medium M, and the material of the ink or based on at least one of these and the print pattern P10. This is because the width and/or material of the printing medium M and the material of the ink are relevant to the temperature rise of the thermal head 10. Moreover, the controller 5 may include in the conditions the length of a print created from the printing medium M by, for example, being cut out after printing.

Here, the upper limit temperature TP is, for example, the upper limit of the operation-guaranteed temperature of the thermal head 10. However, the controller 5 may set a threshold temperature TT using, as the upper limit temperature TP, a temperature different from the upper limit of the operation-guaranteed temperature (for example, a temperature lower than the upper limit of the operation-guaranteed temperature for giving room).

Then, the controller 5 acquires a head temperature TH from a sensor signal output from the thermistor 13 (Step S13). Then, the controller 5 compares the head temperature TH with the threshold temperature TT (Step S14).

If determined that the head temperature TH is lower than the threshold temperature TT (Step S14: YES), the head temperature TH is projected not to reach the upper limit temperature TP even if rising, whereby the controller 5 executes the printing (Step S15). The printing is executed, as described above, by the controller 5 controlling the thermal head 10 to print while the stepping motor 12 and the platen roller 21 convey the printing medium M.

On the other hand, if determined that the head temperature TH is not lower than the threshold temperature TT as shown in FIG. 7 (Step S14: NO), the controller 5 repeats the processing of acquiring a head temperature TH (Step S13) and the processing of comparing the head temperature TH with the threshold temperature TT (Step S14) until the head temperature TH becomes lower than the threshold temperature TT. As a result, the printing is put in the standby state and the head temperature TH lowers to a temperature TH-1 lower than the threshold temperature TT as shown in FIG. 7.

As the head temperature TH lowers to the temperature TH-1 lower than the threshold temperature TT as described above, the controller 5 determines that the head temperature TH is lower than the threshold temperature TT (Step S14: YES) and executes the printing (Step S15). However, it may take a long time for the head temperature TH to become lower than the threshold temperature TT for some reason such as a high environment temperature. Therefore, when the head temperature TH does not become lower than the threshold temperature TT after being on standby for a given time, the printing device 1 may notify the user of the situation by making a warning sound or the controller 5 may automatically raise the threshold temperature TT (or the upper limit temperature TP) as the time goes by. Here, only being on standby after some print operation may cause the user to be anxious about a failure or the like of the printing device 1. Therefore, the printing device 1 may give the above notice to the user when determined for the first time that the head temperature TH is not lower than the threshold temperature TT.

In the above-described embodiment, the printing device 1 comprises the conveyer conveying the printing medium M (for example, the stepping motor 12 and the platen roller 21), the thermal head 10 that is an example of the printer printing onto the printing medium M, the thermistor 13 that is an example of the temperature sensor measuring the temperature of the thermal head 10, and the controller 5 controlling the conveyer and the thermal head 10. This controller 5 projects the temperature of the thermal head 10 along with printing from the print pattern and determines whether the projected head temperature TH of the thermal head 10 reaches the upper limit temperature TP (Steps S12 to S14), controls the conveyer and the thermal head 10 to perform the printing (Step S15) when determined that the head temperature TH does not reach the upper limit temperature TP (Step S14: YES), and controls the conveyer and the thermal head 10 not to perform the printing when determined that the head temperature TH reaches the upper limit temperature TP (Step S14: NO).

Therefore, even if the head temperature TH rises along with printing, it is possible to prevent the head temperature TH from reaching the upper limit temperature TP in the middle of printing with no additional complex configuration. As a result, it is possible to prevent the resultant print from being blurred, collapsed, and/or uneven in density, which occurs when printing is suspended in the middle of printing for suppressing damage and/or defective operation of the thermal head 10 due to the temperature rise. Thus, according to this embodiment, it is possible to suppress deterioration in the print quality due to the temperature rise of the thermal head 10 with a simple configuration.

Moreover, in this embodiment, the thermal head 10 has multiple heater elements 10*a*. Then, the controller 5 projects and determines whether the head temperature TH reaches the upper limit temperature TP based on any of the total number of heater elements 10*a* made to generate heat for printing the print pattern P10 and the ratio of the multiple heater elements 10*a* made to generate heat for printing the print pattern P10, or further based on at least one of the width of the printing medium M, the material of the printing medium M, the material of the ink, and the like. As a result, the controller 5 can easily project the temperature rise of the thermal head 10.

Another Embodiment

Another embodiment is different from the above-described Embodiment 1 in that Steps (Steps S24 and S28 to S30) are added in which the controller 5 determines the positions of one or more suspension candidate regions An based on the print pattern P10 and projects and determines whether the head temperature TH reaches the upper limit temperature TP before printing each suspension candidate region An since the start of printing. The other matters can be the same and thus, the following description is focused on the difference.

Figure 9:
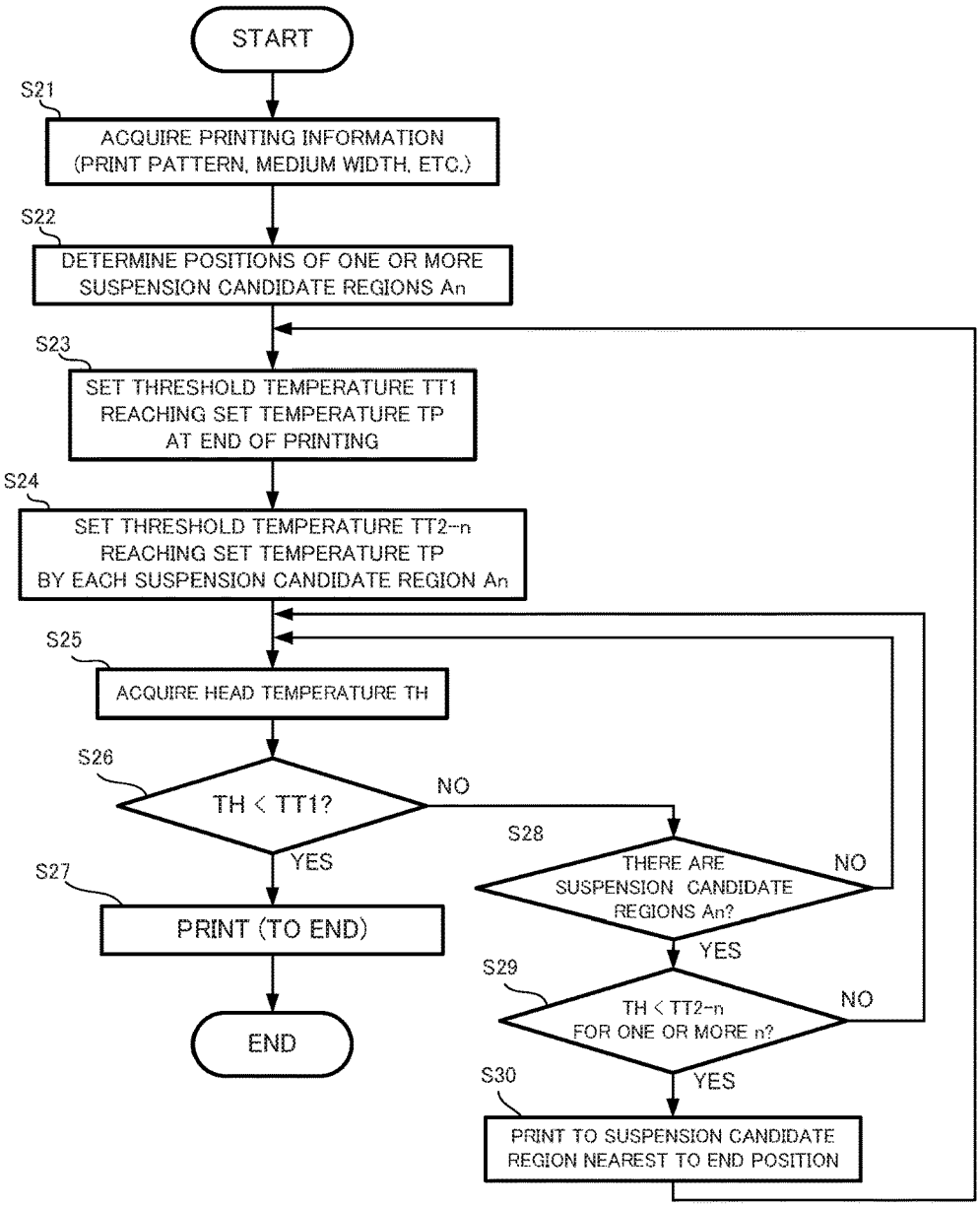
FIG. 9 is a flowchart for explaining the control method of the printing device according to another embodiment.

FIG. 9 is a flowchart for explaining the control method of the printing device according to another embodiment.

Figure 10:
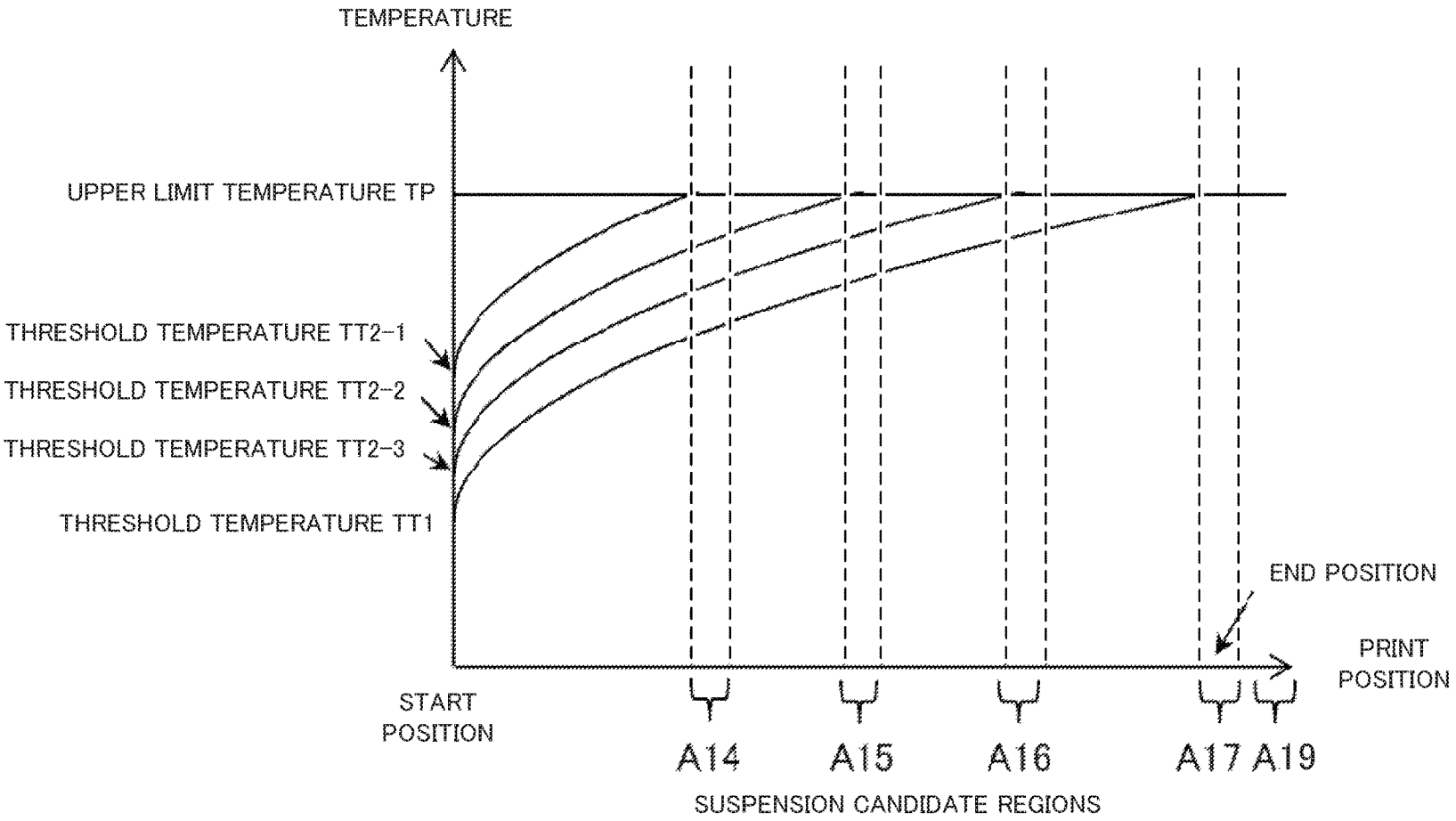
FIG. 10 is a graph for explaining the projected temperature rise in the other embodiment.

FIG. 10 is a graph for explaining the projected temperature rise of the print head.

The controller 5 acquires printing information such as the print pattern P10, the width and/or material of the printing medium M, and the material of the ink (Step S21).

Then, the controller 5 determines the positions of one or more suspension candidate regions An in the print pattern 10 that are candidates for suspending the printing in the middle of printing (Step S22). The suspension candidate regions An are, for example, non-print regions A11 to A17 of the print pattern P10 where nothing is printed in the example of FIG. 11. The non-print regions A11 to A17 are non-print regions A11 and A17 corresponding to the right and left margins and non-print regions A12 to A16 between the characters "ABCDEF" of the print pattern P10. Moreover, a leading marginal region A18 is provided to the left of the non-print region A11 and a trailing marginal region A19 is provided to the right of the non-print region A17 on the printing medium M that is a label to create. Also in these regions, nothing is printed. Here, in FIG. 11, the dash-dot-dot line between the leading marginal region A18 and the suspension candidate region A11 and the dash-dot-dot line between the suspension candidate region A17 and the trailing marginal region A19 are imaginary lines indicating the boundaries between those regions. These lines are not included in the print pattern P10. Moreover, the boundary between the leading marginal region A18 and the suspension candidate region A11 corresponds to the print start position and the boundary between the suspension candidate region A17 and the trailing marginal region A19 corresponds to the print end position. Moreover, when there is no region satisfying conditions for determining the suspension candidate regions An, the controller 5 does not determine the suspension candidate regions An and omits the Steps S28 to S30 described later.

Figure 12:
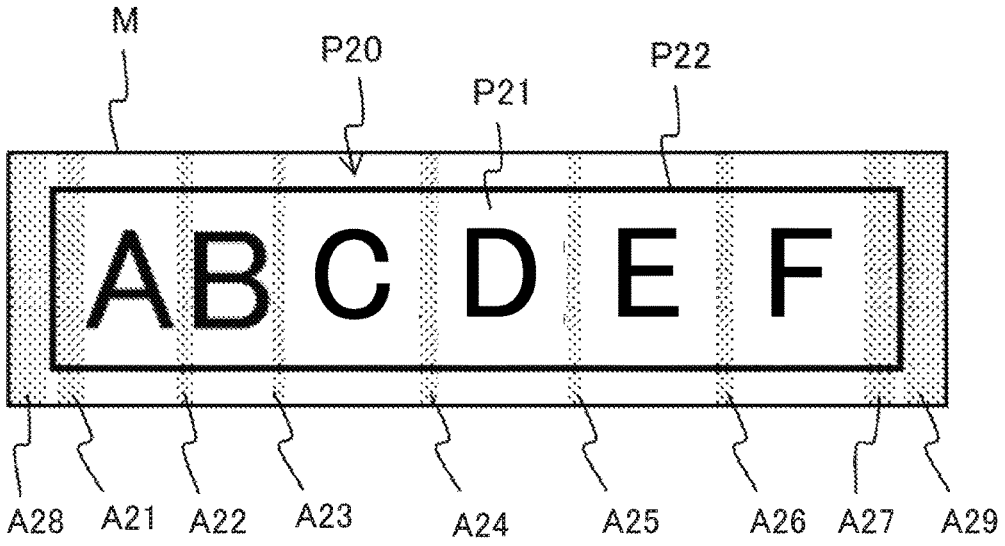
FIG. 12 is an illustration for explaining the suspension candidate regions in a modified embodiment of the other embodiment.

The suspension candidate regions An may be, as shown in FIG. 12, a leading marginal region A28, a trailing marginal region A29, and selected regions A21 to A27 selected from the print regions of a pattern P20 including a pattern P21 comprising characters "ABCDEF" and a pattern P22 enclosing the pattern P21. The selected regions A21 to A27 are regions situated between the characters of the character pattern P21 and situated only on the lines of the rectangular pattern P22 that extend in the horizontal direction (the conveying direction). Printing may be suspended in these selected regions A21 to A27. However, compared with other print regions, the regions situated only on the lines extending in the conveying direction are presumably unlikely to cause deterioration in the print quality even if printing is suspended in the middle of printing. Therefore, the controller 5 selects these selected regions A21 to A27 as suspension candidate regions An. However, the selected regions A21 to A27 can be selected under any conditions. For example, the controller 5 may use priority weighting for determining selected regions for each of the patterns P21 and P22 such as selecting as selected regions the print regions other than the print regions of the pattern P21.

Then, the controller 5 sets a threshold temperature TT1 that is a temperature at the start of printing from which the head temperature TH is projected to reach the upper limit temperature TP at the end of printing (Step S23).

Moreover, the controller 5 sets one or more threshold temperatures TT2-*n* from which the head temperature TH is projected to reach the upper limit temperature TP by one or more suspension candidate regions An (Step S24). Specifically, for example, when there are three suspension candidate regions (A14, A15, and A16) as in the example shown in FIG. 10, the controller 5 sets threshold temperatures TT2-1, TT2-2, and TT2-3 from which the head temperature TH is projected to reach the upper limit temperature TP by the print position reaching the suspension candidate regions A14, A15, and A16, respectively. Here, in the example of FIG. 11, the controller 5 has only to set the threshold temperature TT2-*n* corresponding to the suspension candidate regions A11 to A17, respectively. However, the controller 5 may ignore the non-print regions A11 and A17 corresponding to the left and right margins of the print pattern P10 by judging that there regions are the region before the start of printing or the region after the end of printing. In other words, the controller 5 may determine that something is printed from the rear end (the right side) of the non-print region A11 to the front end (the left side) of the non-print region A17 in the conveying direction (the rightward direction in FIG. 11). In other words, as shown in FIG. 10, the rear end (the right side) of the non-print region A11 may correspond to the print start position and the front end (the left side) of the non-print region A17 may correspond to the print end position.

Moreover, the controller 5 can project the temperature rise for setting the threshold temperatures TT1, TT2-1, TT2-2, and TT2-3 based on the print pattern P10 or the like as described above.

Then, the controller 5 acquires a head temperature TH from a sensor signal output from the thermistor 13 (Step S25). Then, the controller 5 compares the head temperature TH with the threshold temperature TT1 (Step S26).

If determined that the head temperature TH is lower than the threshold temperature TT1 (Step S26: YES), the head temperature TH is projected not to reach the upper limit temperature TP by the print end position even if rising, whereby the controller 5 executes the printing to the print end position with no suspension along the way (Step S27).

On the other hand, if determined that the head temperature TH is equal to or higher than the threshold temperature TT1 (Step S26: NO), the controller 5 determines whether there are suspension candidate regions An (Step S28). If there are suspension candidate regions An (Step S28; YES), the controller 5 compares the head temperature TH with each of the threshold temperatures TT2-1, TT2-2, and TT2-3 corresponding to the suspension candidate regions A14, A15, and A16 (Step S29). If determined that the head temperature TH is lower than at least one of the threshold temperatures TT2-1, TT2-2, and TT2-3 (Step S29: YES), the controller 5 assumes that even if rising, the head temperature TH does not reach the upper limit temperature TP by at least one position (an temperature-unreachable suspension position) corresponding to at least one threshold temperature (an unreachable threshold temperature) compared with which the head temperature TH is determined to be lower, and executes the printing to at least one temperature-unreachable suspension position with no suspension along the way (Step S30). After printing to at least one temperature-unreachable suspension position, the controller 5 executes the processing again from the processing of setting a threshold temperature TT1 in the Step S23.

Here, when there are multiple threshold temperatures TT2 as in this embodiment, the controller 5 does not need to always compare the head temperature TH with all threshold temperatures TT2-1, TT2-2, and TT2-3. The controller 5 may make comparison in sequence starting with the threshold temperature TT2 corresponding to the suspension candidate region nearest to the print end position. Generally, as shown in FIG. 10 and the like, the printed length and the corresponding magnitude of temperature rise have a positive correlation and therefore, multiple threshold temperatures TT2 satisfies the following expression (1):

$$TT2\text{-}1 > TT2\text{-}2 > TT2\text{-}3 \qquad \text{Expression (1)}$$

Hence, if determined that the head temperature TH is lower than the threshold temperature TT2-3 when compared with the threshold temperatures TT2-3, TT2-2, and TT2-1 corresponding to the suspension candidate regions A16, A15, and A14, respectively, in this order, it is obvious that the expression (2) is satisfied and thus the controller 5 can omit the processing of comparing the head temperature TH with the remaining threshold temperatures TT2-2 and TT2-1:

$$TT2\text{-}1 > TT2\text{-}2 > TT2\text{-}3 > TH \qquad \text{Expression(2)}$$

If there are no suspension candidate regions An (Step S28: NO) or if determined that the head temperature TH is equal to or higher than a threshold temperature TT2-*n* for all threshold temperatures TT2-*n*(TT2-1, TT2-2, and TT2-3) (Step S29: NO), the controller 5 repeats the processing of acquiring a head temperature TH and comparing the head temperature TH with the threshold temperatures TT1 and TT2 (Steps S25, S26, S28, and S29) until the head temperature TH becomes lower than the threshold temperature TT1 or TT2. As a result, the printing device 1 is put in the standby state in which no printing is performed. As a result, the head temperature TH lowers below the threshold temperature TT2 (for example, the threshold temperature TT2-3 corresponding to the nearest suspension candidate region A16).

Figure 13:
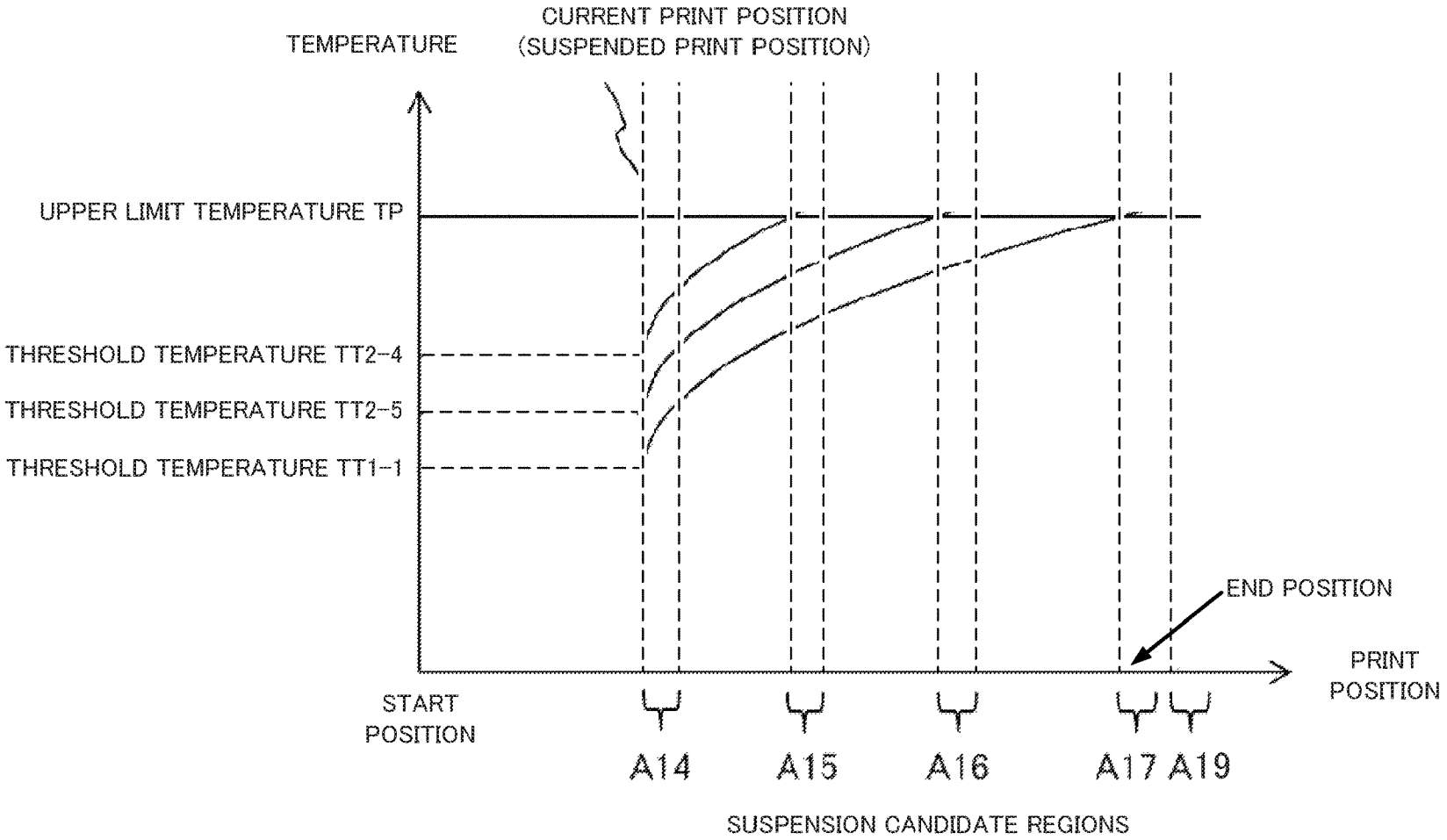
FIG. 13 is a graph for explaining the projected temperature rise in the middle of printing in the other embodiment.

For example, when printing is performed to the suspension candidate region A14 and suspended as shown in FIG. 13, the controller 5 sets a threshold temperature TT1-1 that is the temperature at the resumption of printing from which the head temperature TH is projected to reach the upper limit temperature TP at the end of printing based on the current print position (the printing suspension position) (Step S23). Here, in FIG. 13, similar to FIG. 10, it is assumed that the rear end (the right side) of the non-print region A11 corresponds to the print start position and the front end (the left side) of the non-print region A17 corresponds to the print end position. Moreover, the controller 5 sets one or more threshold temperatures TT2-4 and TT2-5 from which the head temperature TH is projected to reach the upper limit temperature TP by one or more remaining suspension candidate regions A15 and A16 between the current print position and the print end position (Step S24). Then, the controller 5 executes the processing of acquiring a head temperature TH (Step S25) and the subsequent processing as described above. Here, if there is no remaining suspension candidate region An, the Step S24 is omitted at this stage and the processing of the Steps S25 and S26 is repeated as in the Steps S13 and S14 of FIG. 6.

Also in the above-described embodiment, the controller 5 projects and determines whether the head temperature TH of the thermal head 10 reaches the upper limit temperature TP as in the above-described Embodiment 1. Therefore, this embodiment can also suppress deterioration in the print quality due to the temperature rise of the thermal head 10 with a simple configuration.

Figure 11:
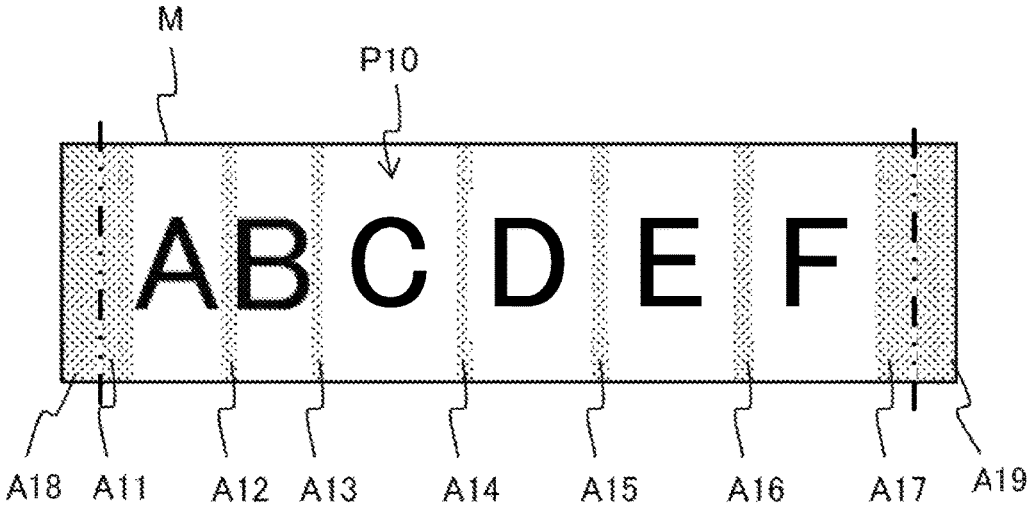
FIG. 11 is an illustration for explaining the suspension candidate regions in the other embodiment.

Moreover, in this embodiment, the controller 5 sets the suspension candidate regions An of the print pattern P10 that are candidates where the printing is suspended in the middle of printing (for example, the suspension candidate regions A14 to A16 shown in FIG. 10 and the suspension candidate regions A11 to A17 shown in FIG. 11) and projects and determines whether the head temperature TH reaches the upper limit temperature TP before the print position reaches the suspension candidate regions An (Steps S22, S24, S25, S28, and S29). Therefore, the printing device 1 can print up to at least any of the suspension candidate regions An even if the head temperature TH is projected to reach the upper limit temperature TP before the end of printing of the print pattern P10.

Moreover, in this embodiment, the suspension candidate regions An set by the controller 5 include, for example as shown in FIG. 12, at least either one of the non-print regions A28 and A29 of the print pattern P20 where nothing is printed and the selected regions A21 to A27 selected from the print regions of the print pattern P20 where something is printed. Therefore, it is possible to prevent deterioration in the print quality by setting as the suspension candidate regions An the regions where nothing is printed such as the non-print regions A28 and A29 and/or the regions where, for example, suspension of printing is unlikely to cause deterioration in the print quality such as the selected regions A21 to A27 selected from the print regions.

As described above, the present disclosure can apply various changes or modifications to the above specific embodiments and embodiments including such changes or modifications are included in the technical scope of the present disclosure, which is apparent to a person in the field from the description in the scope of claims.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A printing device, comprising:

a printer that prints onto a printing medium that is conveyed along a reference direction by a conveyer; and a controller that controls the printer to print a print pattern onto the printing medium along the reference direction, wherein, when a temperature of the printer is projected to become equal to or higher than a set temperature during a print of the print pattern on the printing medium for a length from a start position of printing to an end position of the printing, the set temperature being previously set, the controller:

defines, as a stop position, a portion that is selected from portions of the print pattern where the temperature of the printer does not become equal to or higher than the set temperature and no heater elements of the printer are controlled to generate heat, and controls the printer to stop printing after executing the printing up to the stop position.

2. The printing device according to claim 1, wherein:

at the stop position where the printing by the printer is stopped, when the temperature of the printer decreases to a temperature from which the temperature of the printer is projected not to reach the set temperature previously given as an upper limit of temperature of the printer during a print of the print pattern on the printing medium for the length from the stop position to the end position of the printing, the controller controls the printer to execute printing.

3. The printing device according to claim 1, wherein the controller determines whether the temperature of the printer becomes equal to or higher than the set temperature while the printer is not printing.

4. The printing device according to claim 1, wherein the controller sets the set temperature to a different temperature in accordance with a width of the printing medium, the temperature of the printer while not printing, or an operation environment temperature of the printing device while not printing.

5. The printing device according to claim 1, wherein the controller determines whether the temperature of the printer becomes equal to or higher than the set temperature based on content of the print pattern, a material of the printing medium, or a material of ink printed onto the printing medium.

* * * * *